United States Patent [19]

Field

[11] 4,240,556

[45] Dec. 23, 1980

[54] INFLATABLE PACKAGE AND METHOD OF MANUFACTURE

[76] Inventor: Andrew S. Field, 300 West 12 Street, New York, N.Y. 10014

[21] Appl. No.: 880,699

[22] Filed: Feb. 23, 1978

[51] Int. Cl.[3] ..... B65D 81/14; B65D 81/20

[52] U.S. Cl. ..... 206/522; 53/408; 229/62.5

[58] Field of Search ..... 206/521-522, 206/583-584, 591-594; 229/62.5; 53/408

[56] References Cited

U.S. PATENT DOCUMENTS

| | | | |
|---|---|---|---|
| 1,827,322 | 10/1931 | Lindermann | 206/522 |
| 3,009,566 | 11/1961 | Oakley | 206/591 |
| 3,406,746 | 10/1968 | Abildgaard | 206/591 X |
| 4,190,158 | 2/1980 | Ambrose | 206/522 |

FOREIGN PATENT DOCUMENTS

| | | | |
|---|---|---|---|
| 1603215 | 4/1971 | France | 206/522 |

*Primary Examiner*—Stephen Marcus

*Attorney, Agent, or Firm*—McAulay, Fields, Fisher, Goldstein & Nissen

[57] ABSTRACT

A double walled tubular flexible plastic package has an inflatable annular chamber surrounding an inner pocket. When an object is placed in the pocket and the chamber is inflated, the inner wall collapses inward to envelop the object. The inflation causes the flexible membrane to close off at the mouth of the pocket thereby substantially encapsulating the object being packaged. The object is essentially supported within a single air chamber thereby providing optimum cushioning from external forces and substantial insulation from external temperatures.

5 Claims, 2 Drawing Figures

INFLATABLE PACKAGE AND METHOD OF MANUFACTURE

BACKGROUND OF THE INVENTION

This invention relates to an air inflated package used to encapsulate an item to be shipped.

Many packaging devices are known in which air is used as part of the means for cushioning the product or item being packaged. Bubbles of air encapsulated in a plastic sheet is one widely used technique. The purpose of such packaging is to cushion the item against forces that impinge on the package during shipment. In packaging, more than in most areas, there is a significant trade-off between the cost of the package, the effectiveness of the package and the range of items with which it may be employed. There is always a practical line that has to be drawn between the cost of increasing the isolation and insulation of the item being shipped and the risk of damage, all in the context of the value of the item involved.

Accordingly, it is a major purpose of this invention to provide an improved packaging technique in that a high level of isolation from external forces is achieved at a lower cost than has hitherto been the case. More specifically, it is the purpose of this invention to provide an improved combination of cost and packaged product isolation.

In certain circumstances, a degree of insulation from the temperature of the environment is a useful packaging function particularly for the transportation of hot or cold foods over short distances or for short periods of time. Accordingly, it is a further purpose of this invention to provide an improved package from a cost and force isolation point of view which also provides improved thermal insulation.

It is a further purpose of this invention to provide the improved package in an embodiment that is simple to manufacture, easy to load and easy to seal so that the manufacturing cost is kept low.

From the point of view of the volume of waste disposal and its environmental impact, it has become increasingly urgent in recent years to provide effective packaging for items that are shipped in which the packaging, when disposed, has minimum bulk and weight. Accordingly, it is a further object of this invention to obtain the objects set forth above in a context that minimizes the bulk and weight of the packaging material required.

Generally, a requirement for greater isolation of the object packaged from external forces results in greater bulk and weight of the packaging material. However, an objective achieved by this invention is enhanced isolation with decreased bulk and weight of packaging material.

BRIEF DESCRIPTION

In brief, one embodiment of this invention is manufactured from an open-ended cylindrical tube of highly flexible plastic such as polyethylene. The tube is folded in on itself so that one end of the tube is pulled along the axis of the tube until both open ends of the tube are adjacent one another. The two open ends of the tube are then sealed together and to one another along a transverse line to provide a closed end for the package. At this point, the package is a double-walled pocket having a substantially annular chamber between the two walls. The pocket is sealed at one end and open at the other end. The outer wall and inner wall of this package are topologically continuous because they have been formed from a single cylinder. Because of the way it is formed the axial length of the package is approximately one-half the length of the original single-walled tube from which the package is formed.

The item to be packaged is placed in the pocket and the chamber inflated with air. As the chamber inflates, the inner wall collapses inwardly to completely encompass and substantially encapsulate the item placed in the package. The open end of the package closes off as the flexible wall of the package closes in on itself. The item thus packaged is substantially encapsulated. The encapsulation is not an air-tight encapsulation but it does provide contact between the inner wall of the package and all of the surfaces of the object being packaged. No matter how the package is jolted, the object cannot be shaken out of the package and the single air chamber which cushions the entire item assures that any force applied to the package will be distributed evenly over the surface of the item packaged.

BRIEF DESCRIPTION OF THE DRAWINGS

FIG. 4 illustrates the flexible tubular plastic membrane which is employed as the starting element in fabricating the FIG. 1 package.

FIG. 5 illustrates the step where one end of the FIG. 4 tube is folded in and drawn axially back through the tube to the point wherein two ends of the flexible tube are brought into the same longitudinal plane preparatory to sealing the ends together.

FIG. 6 shows the completed product in which the ends have been sealed together along a line to provide a generally annular inflatable chamber. FIG. 6 also illustrates the loading of an object into the package.

DESCRIPTION OF THE PREFERRED EMBODIMENTS

Figure 1:
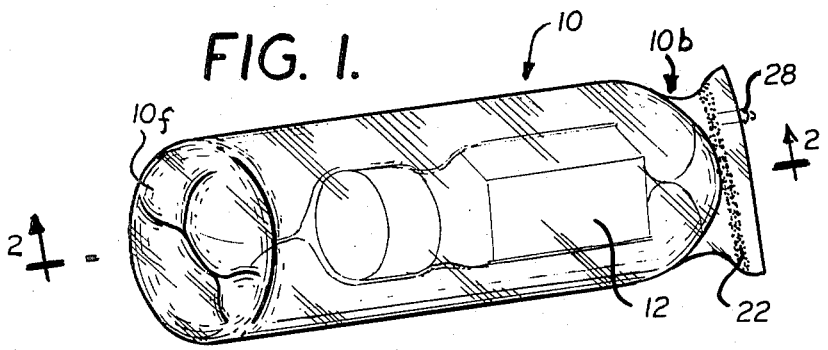
FIG. 1 is a perspective view of one embodiment of the invention illustrating the package of this invention inflated and encapsulating an elongated object having a rectangular section and a necked down section.
Figure 3:
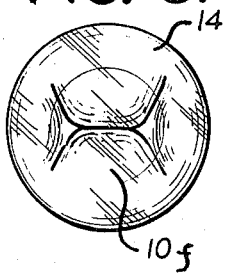
FIG. 3 is an end view of the mouth of the FIG. 1 illustration.
Figure 2:
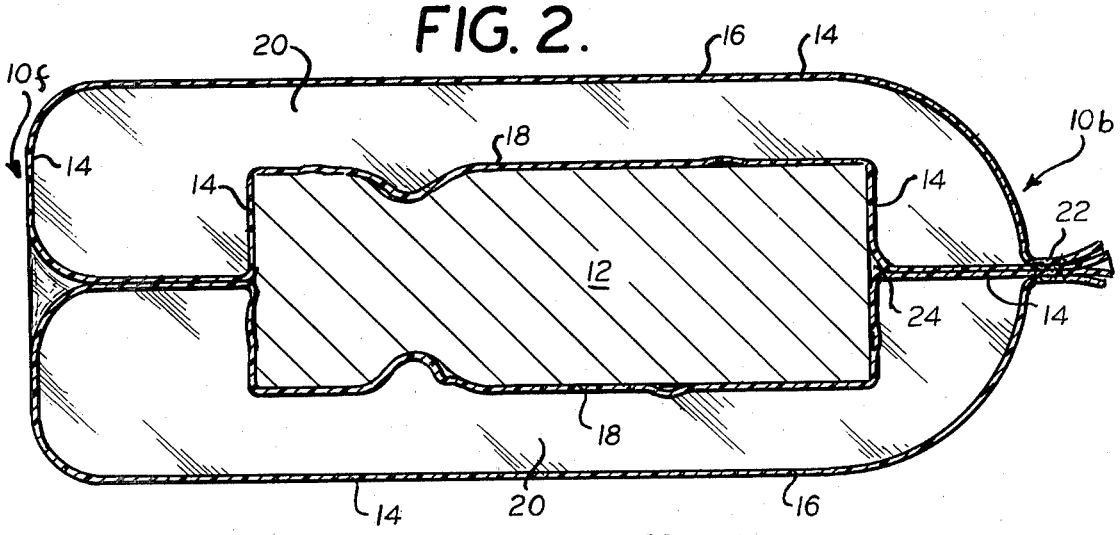
FIG. 2 is an end view of the FIG. 1 device illustrating the manner in which the open end of the package closes off as the package is inflated.

With reference to the FIGS., all of which refer to the same embodiment, the package device 10 is shown encapsulating an elongated object 12 having a portion that is rectangular in cross-section. The package 10 is composed of a flexible plastic membrane 14 which can be a polyethylene material or any other material substantially impervious to air. The membrane 14 is highly flexible so that it will conform to the configuration of the object 12 being encapsulated and packaged.

The package 10 has a wall portion 16 which can be deemed an outer wall and a wall portion 18 which can be deemed an inner wall. The inner wall 18 and the outer wall 16 are, from a topological point of view, a single continuous skin. The outer wall 16 and inner wall 18 between them define an essentially annular chamber 20. This chamber 20 is inflated, as shown in FIG. 1, in order to encapsulate the object 12.

The package 10 can be considered to have a back end 10*b* and a front end 10*f*. At the back end 10*b*, a linear seal 22, which with polyethylene can be a thermal seal, effects the sealing of the annular space 20 and also defines the bottom of a pocket 24 into which the object 12 being packaged is placed. This type of seal is also known as a fin seal because of the fin like effect of the material rearward of the seal.

The front end 10*f* has a mouth through which the object 12 is inserted and withdrawn when the package is deflated.

When the package 10 is inflated to the condition shown in FIG. 1, the inner wall portion 18 collapses inwardly about the object 12 and, because the membrane 14 is highly flexible, conforms to the surfaces of the object 12. At the mouth 10*f* of the package, the wall of the membrane 14 collapses inwardly to contact itself in the manner shown thereby closing off the mouth of the pocket 24. The pressure of the air in the chamber 20 holds the mouth closed and supports the object 12 within the pocket portion 24 of the package 10.

The description of the manner of making the package 10 which is set forth below will aid in visualizing the structure of this package 10.

Any incident forces on the wall of the package 10 will be distributed throughout the entire air filled chamber 20 and thus distributed over the surface of the object 12 thereby providing an effective cushioning of the object 12.

It should be kept in mind that the closing off of the mouth of the pocket 24 as the chamber 20 is inflated, does not effect an airtight or hermetic seal because it is only the surface of the membrane 14 that is being brought together under the pressure of air that closes off the mouth. Because the membrane 14 is highly flexible, the mouth 10*f* will be entirely closed off so that even small objects 12 will not fall out. Thus a group of small objects can be packaged in this type of package.

The preferred material for the membrane 14 is a low density polyethylene coated with a vinylidene chloride to assure impermeability. The coating material is sold be Dow Chemical Company under the tradename Saran.

METHOD OF CONSTRUCTION

Figure 4:
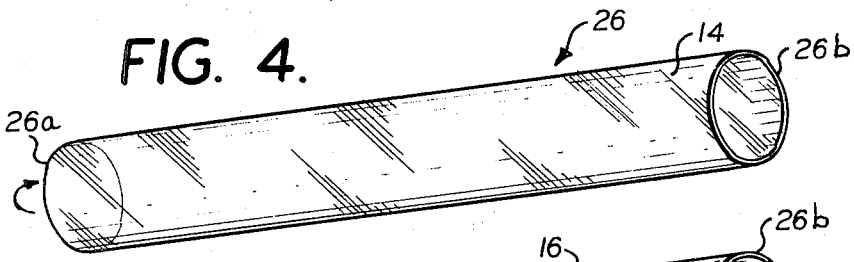
FIGS. 4 through 6 illustrate the method of fabricating the FIG. 1 packaging device.
Figure 5:
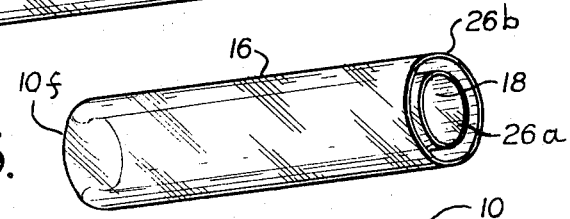
Figure 6:
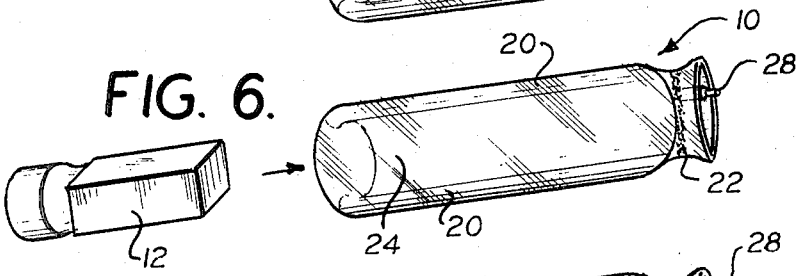
Figure 7:
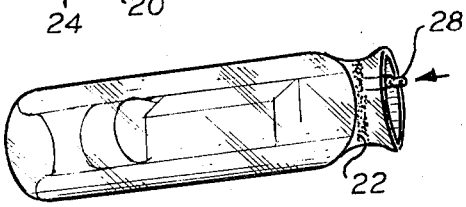
FIG. 7 shows the object within the package preparatory to inflating the package.

As shown in FIGS. 4 through 6, the package 10 is fabricated by starting with a relatively long tubular element 26 which is nothing more than the membrane 14. This tubular element 26 has first and second open ends 26*a* and 26*b*. The end 26*a* is folded radially inward and drawn axially along the interior of the tubular element 26 until it is brought into approximate alignment with the end 26*b* as shown in FIG. 5. In this fashion, the outer wall portion 16 and inner wall portion 18 are substantially defined, and the curved end defines the mouth 10*f* of the package. The two ends 26*a* and 26*b* which are now in alignment are compressed along a line and heat sealed to provide the linear seal 22. This heat seal operation seals the tubular end 26*a* thereby defining the base of the pocket portion 24 into which an object may be placed. This heat seal also seals the end 26*b* of the tube to the end 26*a* of the tube thereby sealing off the annular chamber 20.

A valve 28 is sealed to the membrane 14, preferably while the linear seal 22 is being formed, so that the chamber 20 can be inflated. Because the package is not contemplated to be reusable, it may be preferable to inflate the chamber 20 by a known process that avoids the cost and bulk of a valve. In that process, a needlelike air port is inserted through a small opening left in the fin seal 22 after the package has been loaded with the object 12. Air is pumped through the air port to inflate the chamber. The needle is then withdrawn and heat simultaneously applied to seal off the small opening in the seal 22. This technique is known in the art and therefore is not described in detail here but is mentioned because it may be a preferred mode for inflating a non-reusable package 10 since such a technique will avoid the expense and clumsiness of the valve 28.

The uninflated package 10 shown in FIG. 6 has an open mouth 10*f* into which the object 12 can be placed. When the chamber 20 is inflated, the mouth closes off and the package 10 takes the form shown in FIG. 1.

The axial length of the package must be greater than the outer radius of the inflated package in order to assure sufficient membrane 14 to close off the mouth. If the axial length of the package is inadequate, the result would be something like the toroidal inner tube of a tire when inflated.

Although one embodiment of this invention has been described, there are many variations which can be made by one skilled in this art without departing from the inventive concept. A simple and practical design is shown in which the package is fabricated from a tubular segment 26 that is circular in cross-section. The package could be tailored to be rectangular in cross-section or elliptical in cross-section without departing from the scope of this invention although applicant sees no good reason for such tailoring at this time.

Furthermore, the chamber 20 is refered to as a substantially annular chamber because it is annular throughout most of its length and certainly is annular around the object 12 being packaged. However, when the ends of the chamber collapse on one another to close off the mouth 10*f* and to close off the pocket 24 behind the object 12, the configuration is one that is not strictly annular in the closed off portions. Nonetheless, one recognizes the chamber as being substantially annular even when fully inflated. Accordingly, it should be understood herein that the term substantially annular with reference to the chamber includes a chamber where the chamber, particularly when inflated, will have portions that deviate from annular.

Furthermore, it must be recognized that the encapsulation referred to herein is only a substantial encapsulation since the mouth, when closed off, is not air-tight and further since the membrane 14 along the inner portion 18 will tend to fold over on itself somewhat as it contacts the object 12. In addition, there may be reentrant features in the object 12 or sharp small openings into which the membrane 14 will not collapse and thus there may be small portions of the object 12 that are not in contact with the membrane 14 even when encapsulated.

Reference is made herein to the fact that the length of the package when inflated has to be substantially greater than the radius of the outboard portion 16 in order to make sure that there is enough membrane material to close off the mouth 10*f*. This relationship is essential and is called for in the claims. However, if the cross-sectional configuration of the package is other than circular, the operative radius from the point of view of this relationship would normally be the shortest distance from longitudinal axis to outer portion 16. For example, if the package were elliptical in crosssection, then as long as the longitudinal length of the package is substantially greater than half the minor axis of that elliptical cross-section, there should be enough membrane material to close off the mouth. It should be understood herein that the term "radius" in this context in the specification and in the claims refers to this operative distance.

What I claim is:

1. An inflatable package comprising:

a flexible re-entrant cylindrical membrane having a radially outboard portion and a radially inboard portion extending longitudinally within said outboard portion, said inboard and outboard portions defining a substantially annular chamber between said outboard portion and said inboard portion, said annular chamber being sealed from the ambient atmosphere, said package having a deflated state and an inflated state, said package when in said deflated state having an open mouth at a first end thereof to permit insertion of an object into the space radially inward of said inboard portion of said membrane, said membrane providing a continuous surface from said outboard portion through said mouth to said inboard portion, inflation of said annular chamber causing said inboard portion to collapse in a direction away from said outboard portion tending to conform said inboard portion around whatever object is within said space, inflation also causing said mouth to at least partially close in all radial directions, inflation also causing an automatic adjustment of the portion of said membrane constituting said inboard portion and said outboard portion, said package when in said inflated state having a longitudinal distance substantially greater than a radial dimension of said outboard portion, and when inflated holding whatever object is within said space in a substantially radially centered position surrounded by said annular chamber to provide an air cushion around the object.

2. The inflatable package of claim 1 wherein a second end of said package is sealed along a line transverse to the longitudinal axis of said package, said sealed line defining the back end of a pocket adapted to receive the object to be packaged.

3. The method of packaging an object comprising the steps of:

inserting said object into the mouth of the package of claim 1 when in said deflated state, and inflating said chamber until said inboard portion collapses around said object and substantially encapulates that object and until said mouth substantially closes.

4. The method of manufacturing an inflatable package comprising:

selecting a tubular section of flexible material having first and second open ends and having a substantially constant diameter, said section having an axial length substantially greater than twice its diameter, folding said first open end radially inwardly and bringing said first open end axially through the tubular body into juxtaposition with said second open end, and sealing said first and second open ends to one another to provide a substantially annular sealed chamber having an inboard portion and an outboard portion, whereby said constant diameter permits automatic adjustment of the portion of said material constituting said inboard portion and said outboard portion upon inflation of said chamber.

5. The method of claim 4 wherein said step of sealing comprises effecting a linear seal across said first and second open ends along a line transverse to the axis of the tubular section to seal said first end and thus define the base of a pocket and to seal said second end to said first end and thus seal off said substantially annular chamber.

* * * * *